US009259851B2

(12) United States Patent
Cardew

(10) Patent No.: US 9,259,851 B2
(45) Date of Patent: Feb. 16, 2016

(54) ADAPTABLE ROUTER JIG

(75) Inventor: Tobias M Cardew, Pech-Luna (FR)

(73) Assignee: MPOWER Tools Ltd., Salisbury (GB)

( * ) Notice: Subject to any disclaimer, the term of this patent is extended or adjusted under 35 U.S.C. 154(b) by 854 days.

(21) Appl. No.: 13/491,143

(22) Filed: Jun. 7, 2012

(65) Prior Publication Data

US 2013/0327442 A1 Dec. 12, 2013

(51) Int. Cl.
*B27C 5/10* (2006.01)
*B27C 1/14* (2006.01)

(52) U.S. Cl.
CPC ... *B27C 5/10* (2013.01); *B27C 1/14* (2013.01); *Y10T 29/49826* (2015.01); *Y10T 409/306608* (2015.01)

(58) Field of Classification Search
CPC ..... B27C 1/14; B27C 5/02; B27C 5/10; Y10T 409/306608; Y10T 409/30784; Y10T 409/307952; B23Q 1/0063; B23Q 5/061; B23Q 3/183
USPC ..... 144/144.51, 144.52, 144.1; 269/309–310, 900; 29/281.1
See application file for complete search history.

(56) References Cited

U.S. PATENT DOCUMENTS 3,146,812 A * 9/1964 Fleischer ..... B23Q 35/104 144/144.1
5,203,389 A * 4/1993 Goodwin ..... B27C 9/005 144/134.1
5,630,455 A * 5/1997 Julien ..... B23Q 1/52 144/134.1

* cited by examiner

*Primary Examiner* — Matthew G Katcoff
(74) *Attorney, Agent, or Firm* — David Kiewit

(57) ABSTRACT

A router jig can be attached to a router base by two parallel guide rods extending from a bridge portion of the jig through openings in the router base. In order for a single router jig to be usable with a wide variety of routers, one must select guide rods having an appropriate diameter and must also provide a means of connecting the guide rods to the router jig bridge at a height and a horizontal spacing characteristic of the router being used. This may be done by using two offset arms, each of which is pivotally attached to the bridge at one end and to an associated guide rod at the other end.

10 Claims, 2 Drawing Sheets

ADAPTABLE ROUTER JIG

BACKGROUND OF THE INVENTION

The invention generally relates to guiding a woodworking cutting tool. More specifically, the invention provides a router jig usable with a range of routers having guide rod through-holes in their bases.

BACKGROUND INFORMATION

A router jig can increase the versatility of a hand-held woodworking router by constraining and controlling the motion of a cutting bit. This may include providing better holding stability, cutting mortise trenches, routing a line with respect to a clamp edge, edge routing, making fine adjustments with respect to a reference edge, and cutting circular patterns of various sizes.

Many routers have two parallel guide channels or through-holes extending laterally through the router's base. These channels or holes are generally perpendicular to an axis about which the cutting tool rotates and have a selected one of several diameters. When guide rods having a suitable diameter are inserted through the holes, the router may be slid along the rods into a desired position. The router base is commonly equipped with set screws or other clamping mechanisms to hold the router at a selected position along the guide rods.

The CRB7 router jig, made by M-Power Tools, is a specific example of prior art router jigs. It is usable with a wide variety of routers and couples to these routers by means of two parallel guide rods having one end restrained in a bridge portion of the jig and the other end passing through a respective guide hole provided in a router base.

In fitting a jig to a specific selected router, one must select a set of guide rods having a diameter that allows them to slidingly fit within the through-holes or through channels provided in the router base. Moreover, both lateral and vertical settings of the guide rods must be adjusted to attach the rods to the router. Matching the guide rods to the center-to-center spacing of the router's guide holes is conventionally accomplished by providing at least one horizontally elongated slot in the jig bridge. Vertical setting conventionally involves a cumbersome process of attaching one or more shims between the jig bridge and the jig base in order to raise the guide rods to a height above the jig base that matches the height of the guide holes above the bottom of the router base.

BRIEF SUMMARY OF THE INVENTION

One aspect of the invention is that it provides a router jig attachable to a router base by two parallel guide rods extending from a bridge portion of the jig through respective openings extending through the router base at a selected height, wherein the bridge is attached to the jig base without the use of shims. This attachment arrangement comprises two offset arms, each of which is pivotally attached adjacent one end to a respective attachment point on the bridge, and each of which is pivotally attached adjacent a second end to a respective one of the guide rods.

Another aspect of the invention is that it provides a router guiding apparatus comprising an elongated jig base, a bridge transverse to the base, two guide rods, and two offset arms connecting the guide rods to the bridge. In this apparatus, the guide rods have a diameter selected to slidably fit within respective throughholes or channels in a base of a selected router, and the two offset arms are respectively pivotally attached between one of the guide rods and the bridge at respective positions along the bridge.

Yet another aspect of the invention is that it provides a method of attaching a router to a router jig comprising an elongated jig base and a bridge extending transverse to the elongation direction. The router that is used is conventional in having two parallel through-openings in its base, each of which has a selected diameter, and each of which is at a selected distance above a bottom of the router base. The method couples the router to the base by means of two guide rods and two offset arms pivotable about respective attachment points along the bridge. The method comprises the steps of pivoting each offset arm about the respective attachment point so as to raise the associated guide rod to the selected height above the jig base; and inserting the guide rods, which have a diameter selected to slidably fit within the router base through-openings, into those through-openings; and clamping at least one of the guide rods to the bridge at the respective attachment point.

Those skilled in the art will recognize that the foregoing broad summary description is not intended to list all of the features and advantages of the invention. Both the underlying ideas and the specific embodiments disclosed in the following Detailed Description may serve as a basis for alternate arrangements for carrying out the purposes of the present invention and such equivalent constructions are within the spirit and scope of the invention in its broadest form. Moreover, different embodiments of the invention may provide various combinations of the recited features and advantages of the invention, and that less than all of the recited features and advantages may be provided by some embodiments.

DETAILED DESCRIPTION OF A PREFERRED EMBODIMENT

Figure 1:
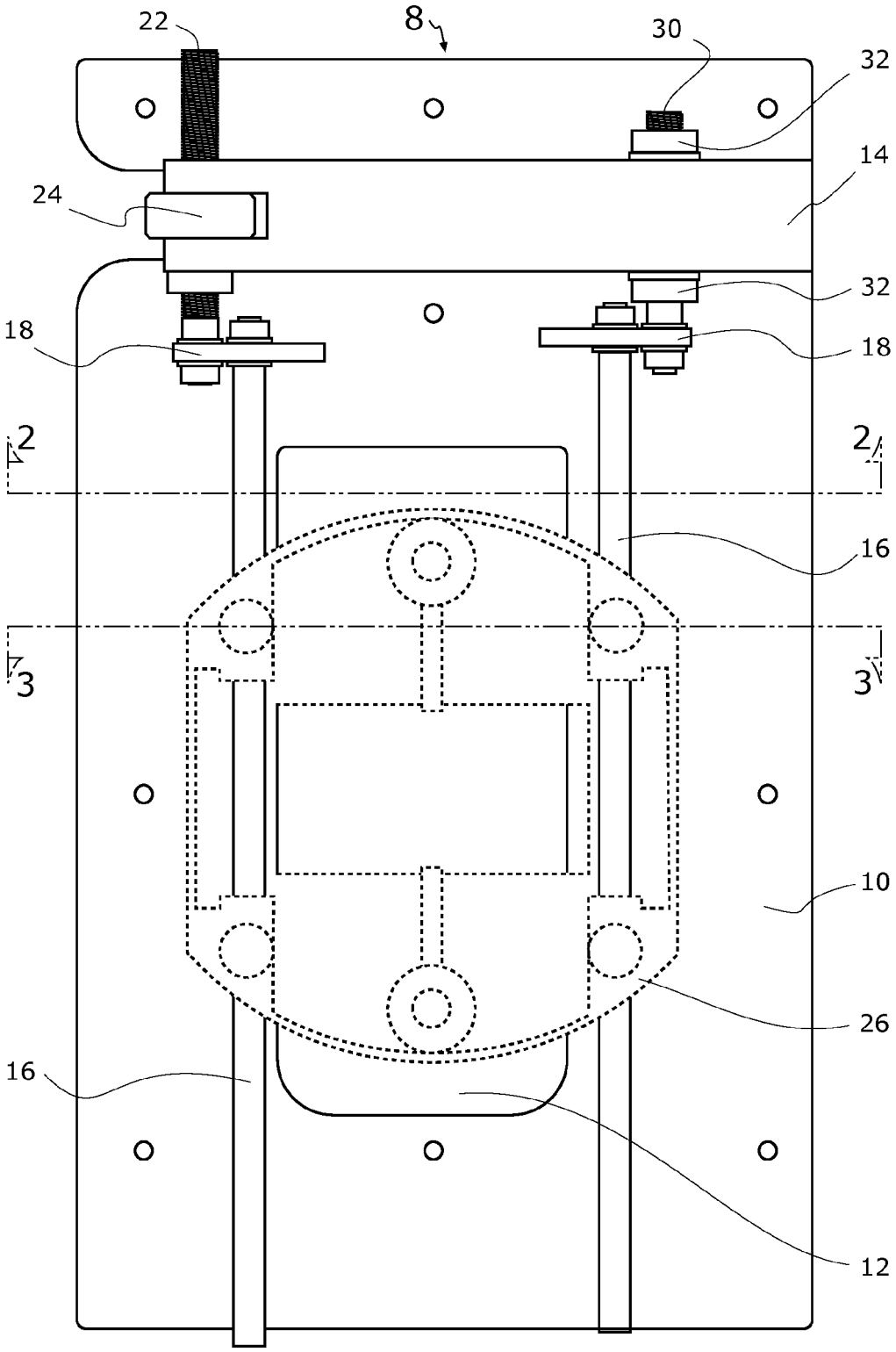
FIG. 1 is a plan view of a router jig attached to a router base by a pair of guide rods pivotally attached to a bridge portion of the router jig.
Figure 2:
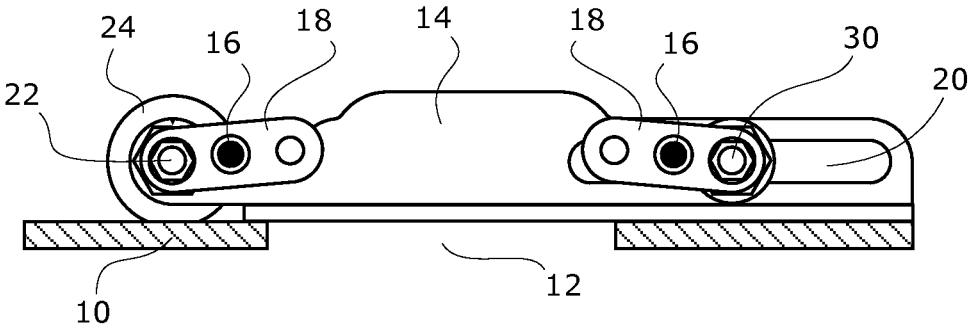
FIG. 2 is a partly sectional view taken as indicated by the arrowed line 2-2 in FIG. 1.
Figure 3:
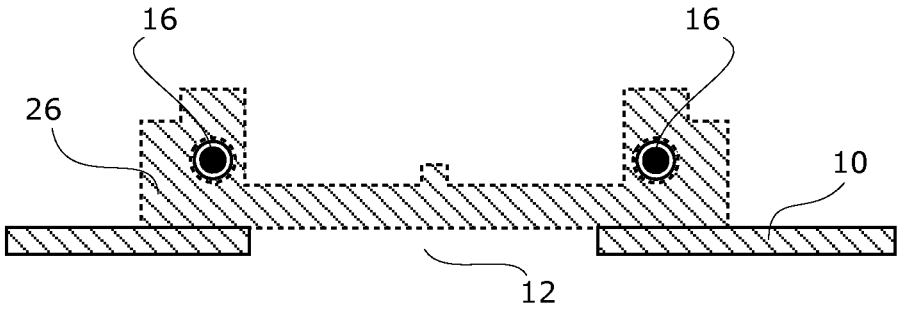
FIG. 3 is a partly sectional view taken as indicated by the arrowed line 3-3 in FIG. 1.

In studying this Detailed Description, the reader may be aided by noting definitions of certain words and phrases used throughout this patent document. Wherever those definitions are provided, those of ordinary skill in the art should understand that in many, if not most, instances such definitions apply both to preceding and following uses of such defined words and phrases.

A preferred height-adjustable router jig 8 of the invention comprises an elongated jig base 10 having an aperture or letterbox cut-out 12 that allows a router bit to extend through the jig base into cutting engagement with a workpiece.

The preferred jig 8 further comprises a bridge 14 extending transverse to the elongation direction of the base 10. The bridge 14 is coupled, by means of pivotable offset arms 18, to two guide rods 16 slidingly fitted within guide holes located in a router base 26. The offset arms are long enough so that when they are pivoted about their respective mounting points 22, 30 they can raise the guide rods 16 high enough above the jig base 10 to accord with the height of the guide rod holes for a wide range of commercially available routers.

At least one of the offset arms 18 is attached to the bridge by a laterally adjustable mechanism to allow the cutter position to be adjusted within the aperture. This lateral adjustment may be made by the depicted combination of a threaded member 30 extending through a lateral slot 20 in the bridge. Although an arrangement of this sort could be used for both offset arms, in preferred embodiments only one of the two offset arms is laterally adjustable. The other, in a particular preferred embodiment, is attached at a fixed point along the bridge 14 by a longitudinal micro-adjuster comprising a threaded member 22 and an adjustment nut 24. The preferred arrangement allows one to clamp a guide rod to the router base (e.g., using clamping means built into the router and not shown in the drawing) so that the router bit is close to a desired cutting position and to then use the longitudinal micro-adjuster to make final fine adjustments to the tool's position along the elongation direction of the aperture 12.

At least one of the offset arms is arranged so that it can be clamped to the bridge to hold the guide rod arrangement in a desired position. In a preferred embodiment this functionality is provided by tightening a nut 32 that clamps one end of an offset rod to the side of the bridge 14. The reader will appreciate that many other sorts of clamping arrangements could be used.

In similar prior art jig bases, a bridge is attached to the base by easily removable threaded fasteners. This allows the user to temporarily remove the bridge from the base in order to install shims between a bottom of the bridge and the jig base. In the present invention the height adjustment is provided more simply by the pivoting arms and no shims are required. In addition, the inventive arrangement allows for a wider range of approaches to attaching the bridge 14 to the jig base 10.

Although the present invention has been described with respect to several preferred embodiments, many modifications and alterations can be made without departing from the invention. Accordingly, it is intended that all such modifications and alterations be considered as being within the spirit and scope of the invention as defined in the attached claims.

The invention claimed is:

1. In a router jig attachable to a router base by two parallel guide rods extending from a bridge portion of the jig through respective openings extending through the router base at a selected height above a base of the router jig, an improvement comprising two offset arms, each offset arm pivotally attached adjacent one end thereof to a respective attachment point on the bridge, each offset arm pivotally attached adjacent a second end thereof to a respective one of the guide rods.

2. The router jig of claim 1 wherein one of the attachment points comprises a micro-adjuster operable to move the associated offset arm perpendicular to the bridge.

3. The router jig of claim 1 wherein at least one of the attachment points is movable along the bridge.

4. The router jig of claim 1 wherein one of the attachment points comprises a clamping mechanism operable to clamp the associated offset arm to the bridge.

5. The router jig of claim 1 wherein each of the offset arms is respectively pivotally attached to the bridge for pivotal motion perpendicular to an associated one of the guide rods.

6. A router guiding apparatus comprising:

a jig base having at least one aperture extending along an elongation direction of the jig base;

a bridge attached to the jig base transverse to the elongation direction;

two guide rods having a diameter selected to slidably fit within respective through-openings in a base of a selected router;

two offset arms, each respectively pivotally attached between a respective one of the guide rods and the bridge at respective positions along the bridge.

7. The router guiding apparatus of claim 6 wherein at least one of the offset arms is pivotally attached to the bridge by means of an adjustment screw operable to move the at least one offset arm perpendicular to the bridge.

8. The router guiding apparatus of claim 6 wherein at least one of the offset arms is pivotally attached to the bridge by a threaded fastener extending through a slot in the bridge.

9. A method of attaching a router to a router jig comprising an elongated jig base and a bridge extending transverse to the elongation direction of the jig base, the method comprising the steps of:

providing the router having two parallel through-openings in a base thereof, each of the through-openings having a selected diameter, each of the through-openings at a selected distance above a bottom of the router base;

providing two guide rods having a diameter selected to slidably fit within the router base through-openings;

attaching the guide rods to the bridge by respective offset arms pivotable about respective attachment points along the bridge;

pivoting each offset arm about the respective attachment point so as to raise the associated guide rod to the selected height above the jig base;

slidably fitting each guide rod into a respective one of the through-openings; and clamping at least one of the guide rods to the bridge at the respective attachment point.

10. The method of claim 9 wherein the clamping step comprises clamping the at least one guide rod to the bridge by means of a threaded fastener extending through a slot extending along the bridge.

* * * * *